US007891333B2

(12) United States Patent
Terada et al.

(10) Patent No.: US 7,891,333 B2
(45) Date of Patent: Feb. 22, 2011

(54) INTERNAL COMBUSTION ENGINE FOR VEHICLE

(75) Inventors: Koji Terada, Saitama (JP); Shinya Wakabayashi, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 399 days.

(21) Appl. No.: 12/054,823

(22) Filed: Mar. 25, 2008

(65) Prior Publication Data

US 2008/0236537 A1 Oct. 2, 2008

(30) Foreign Application Priority Data

Mar. 28, 2007 (JP) ..... 2007-085599

(51) Int. Cl.
*F01M 11/02* (2006.01)

(52) U.S. Cl. ..... 123/196 AB; 123/196 A; 123/41.33

(58) Field of Classification Search ..... 123/41.33, 123/195 R, 195 A, 195 AC, 196 R, 196 A, 123/196 AB, 198 R, 179.1, 179.25
See application file for complete search history.

(56) References Cited

U.S. PATENT DOCUMENTS 6,305,337 B1 * 10/2001 Sumi et al. ..... 123/179.25
6,540,047 B2 * 4/2003 Yasui et al. ..... 123/196 AB
2002/0148662 A1 * 10/2002 Ashida et al. ..... 123/196 R

FOREIGN PATENT DOCUMENTS

JP 2005-42625 A 2/2005

* cited by examiner

*Primary Examiner*—Noah Kamen
(74) *Attorney, Agent, or Firm*—Birch, Stewart, Kolasch & Birch, LLP

(57) ABSTRACT

An electric motor is cooled by an air flow without restricting the degree of freedom in the arrangement of an oil cooler and an oil filter by utilizing a front face of a front portion of an engine body to arrange the electric motor. The engine includes an oil cooler, an oil filter, and an starter motor for driving a crankshaft to rotate. The oil cooler and the starter motor are disposed on a front face, which is directed in an advancing direction of the vehicle, of a front portion of a lower block which forms an engine body. The oil filter is attached to an attachment seat provided on a side face of the front portion which is directed in the sideward direction. A communication oil path for communicating the oil cooler and the oil filter with each other is provided in the inside of the front portion.

16 Claims, 5 Drawing Sheets

INTERNAL COMBUSTION ENGINE FOR VEHICLE

CROSS-REFERENCE TO RELATED APPLICATIONS

The present application claims priority under 35 USC 119 to Japanese Patent Application No. 2007-085599 filed on Mar. 28, 2007 the entire contents of which are hereby incorporated by reference.

BACKGROUND OF THE INVENTION

1. Field of the Invention

This invention relates to an internal combustion engine for a vehicle which includes an oil cooler, an oil filter and an electric motor. More particularly, to an arrangement and an attaching structure of an oil cooler, an oil filter and an electric motor (for example, a starter motor) in an engine body of an internal combustion engine, and an oil path structure.

2. Description of Background Art

An internal combustion engine for a vehicle is known which includes an oil cooler, an oil filter and a starter motor and wherein the oil cooler and the oil filter are disposed at a front portion of an engine body, for example, a crankcase. See, for example, Japanese Patent Laid-Open No. 2005-42625.

Since an electric motor (for example, a starter motor) provided in an internal combustion engine for a vehicle generates heat upon being operated, it is preferable to cool the electric motor. However, where the electric motor is disposed behind an apparatus body of the internal combustion engine and cannot face in an advancing direction of the vehicle, an air flow over the vehicle is intercepted by the apparatus body and is less likely to come to the electric motor. Therefore, it is difficult to utilize the air flow to raise the cooling performance of the electric motor.

On the other hand, since an apparatus disposed on the front side of the engine body is likely to be blown by the air flow, where an oil cooler and an oil filter are disposed in a juxtaposed relationship in the advancing direction of the vehicle at the front portion, the oil cooler and the oil filter are cooled by the air flow, and cooling of the oil can be anticipated. However, on an outer face which includes a front face and side faces of the front portion of the engine body, portions which are not occupied by the oil cooler and the oil filter remain without being utilized for an arrangement of any apparatus whose cooling is demanded.

Further, the front portion of the engine body sometimes has a projecting face formed such that an outer face (for example, the front face) of a wall (for example, a front wall) to which the oil cooler or the oil filter is attached projects outwardly (for example, forwardly) in a swollen shape, and a projection which projects outwardly is sometimes provided on the outer face. By utilizing the projecting face or the projection, it is possible to achieve a reduction in the size and weight of an attachment boss to which the oil cooler, oil filter or electric motor is attached while assuring the required rigidity of the attachment boss.

Further, with regard to an oil path for introducing oil having passed through the oil filter and the oil cooler to an oil supply reception section (for example, a main bearing for supporting a crankshaft), in order to reduce the power loss upon driving of the oil pump, it is preferable to reduce the communication resistance to achieve a reduction of the pressure loss of the oil.

SUMMARY AND OBJECTS OF THE INVENTION

The present invention has been made in view of such circumstances as described above. It is an object of an embodiment of the present invention to achieve an improvement of the cooling performance of an electric motor by an air flow without restricting the degree of freedom in the arrangement of an oil cooler and an oil filter by utilizing an outer face of a front portion of an engine body to arrange the electric motor. It is an object of an embodiment of the present invention to achieve a reduction in the size and weight of the attachment bosses for an oil cooler and an electric motor. It is an object of an embodiment of the present invention to achieve a compact arrangement of an oil cooler and an electric motor. It is an object of an embodiment of the present invention to achieve a reduction in the size in a vehicle widthwise direction of an internal combustion engine wherein an oil cooler, an electric motor and an oil filter are attached to a front portion of a crankcase. It is an object of an embodiment of the present invention to achieve an easier formation of a communication oil path and a reduction of the pressure loss of oil to be supplied to a main bearing.

According to an embodiment of the present invention, an internal combustion engine for a vehicle includes an oil cooler, an oil filter communicating with the oil cooler through a communication oil path, and an electric motor configured to drive a crankshaft to rotate. The oil cooler and the oil filter are attached to a front portion of an engine body in such a manner as to face in an advancing direction of the vehicle. The oil cooler, the oil filter and the electric motor are disposed on an outer face of the front portion which includes a front face which faces in a forward direction which is the advancing direction and a side face directed in a sideward direction perpendicular to the advancing direction. The communication oil path is provided in the inside of the front portion while the electric motor is disposed so as to face forwardly.

According to an embodiment of the present invention, the oil cooler is disposed on the front face wherein the oil filter is attached to an attachment seat provided on the side face, that part of the attachment seat has a swollen portion formed therein in such a manner so as to be swollen forwardly from the side face. In addition, an oil cooler attachment boss to which the oil cooler is attached is provided at the swollen portion in such a manner as to project forwardly.

According to an embodiment of the present invention, the front face has a projecting face which projects forwardly, and a cooler attachment boss to which the oil cooler is attached and a motor attachment boss to which the electric motor is attached are provided on the projecting face in such a manner so as to project forwardly from the projecting face.

According to an embodiment of the present invention, the oil cooler which has a cylindrical case having a center axis directed forwardly and the electric motor having a drive shaft which projects in a vehicle widthwise direction from the front portion are disposed in a juxtaposed relationship in the vehicle widthwise direction. In addition, the electric motor is disposed such that the center line of rotation of the drive shaft is positioned higher than the center axis thereof.

According to an embodiment of the present invention, the front face has a swollen face formed by causing a front wall having the front face to be curved and project forwardly in order to prevent an interference with a crank web of the crankshaft. In addition, another cooler attachment boss to which the oil cooler is attached and another motor attachment boss to which the electric motor is attached are provided in such a manner so as to project forwardly on the swollen face.

According to an embodiment of the present invention, the engine body which has the front portion is a crankcase, and that the oil filter is entirely disposed within the width of the crankcase in the vehicle widthwise direction.

According to an embodiment of the present invention, a hole which extends linearly along a half line which extends from the oil pump to the oil cooler is partitioned by a partition member to form a first oil path and a second oil path. The first oil path is an instruction oil path for introducing oil from the oil pump to the oil filter. The second oil path is the communication oil path which introduces the oil from the oil filter to the oil cooler. The oil from the oil cooler flows into a main oil path from which an oil path for supplying the oil to a main bearing for the crankshaft through a discharge oil path, and that the discharge oil path and the main oil path are disposed nearer to the crankshaft than the introduction oil path and the communication oil path.

According to an embodiment of the present invention, since the electric motor attached to a position of the front portion of the engine body which faces in the advancing direction of the vehicle is cooled by air flow, the cooling performance thereof is improved. In addition, since the electric motor is disposed on the outer face which is formed from the front face and the side face of the front portion, the electric motor can be disposed at a position of the front portion at which air flow is likely to be received. In addition, since the electric motor does not restrict the formation of the communication oil path which is provided in the inside of the front portion, although the electric motor is disposed in the front portion, the degree of freedom in the arrangement of the oil cooler and the oil filter is not restricted.

According to an embodiment of the present invention, since the projection amount of the attachment boss to which the oil cooler is attached can be reduced by an amount by which the swollen portion projects forwardly, the rigidity of the attachment boss is raised and is reduced in size and weight. Further, since the attachment boss is provided on the attachment seat, the oil cooler and the oil filter can be disposed closely to each other. Consequently, the communication oil path can be reduced in length and the pressure loss (and accordingly the communication resistance) of oil can be reduced. In addition, this contributes to a compaction of the arrangement of the oil cooler and the oil filter. Further, since the contact area between the attachment seat and air flow increases by an amount corresponding to the swollen portion which is swollen forwardly, the swollen portion serves as a heat radiation section and contributes to an improvement of the cooling performance of oil which circulates through the oil filter.

According to an embodiment of the present invention, the projection amount of the attachment bosses which define a maximum width of the oil cooler in the vehicle widthwise direction can be reduced by an amount by which the projecting face projects forwardly. Therefore, the rigidity of the attachment bosses is raised, and the attachment bosses are reduced in size and weight.

According to an embodiment of the present invention, a portion which defines a maximum width of the oil cooler in the vehicle widthwise direction and a portion which defines a maximum width of the electric motor in the vehicle widthwise direction can be disposed in an offset relationship in the upward and downward direction. As a result, the oil cooler and the electric motor can be disposed further closely to each other in the vehicle widthwise direction, and a compact arrangement of the oil cooler and the electric motor in the vehicle widthwise direction can be anticipated. Also where the electric motor, which has a large size in the vehicle widthwise direction is adopted, the projection of the drive shaft in the vehicle widthwise direction can be suppressed. Consequently, an increase in the size of the internal combustion engine in the vehicle widthwise direction can be suppressed.

According to an embodiment of the present invention, the projection amount of the individual attachment bosses projecting forwardly from the swollen face which prevents an interference with the crank web can be reduced by an amount by which the swollen face projects forwardly. Therefore, the rigidity of the attachment bosses can be raised and the attachment bosses can be reduced in size and weight.

According to an embodiment of the present invention, the oil filter can be disposed rather near to the center of the lower block in the vehicle widthwise direction. Consequently, the projection of the oil filter in the vehicle widthwise direction is prevented and the appearance of the internal combustion engine is improved.

According to an embodiment of the present invention, since the first oil path and the second oil path which are part of the oil path for introducing the oil from the oil pump to the oil cooler are formed by partitioning the hole which extends linearly from the oil pump to the oil cooler, the formation of the introduction oil path and the communication oil path is facilitated. Further, since the discharge oil path and the main oil path are disposed rather near to the crankshaft than the introduction oil path and the communication oil path, the oil path length from the main oil path to the main bearing can be reduced. Consequently, the pressure loss of oil to be supplied to the main bearing 9 can be reduced.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

In the following, an embodiment of the present invention is described with reference to FIGS. 1 to 5.

Figure 1:
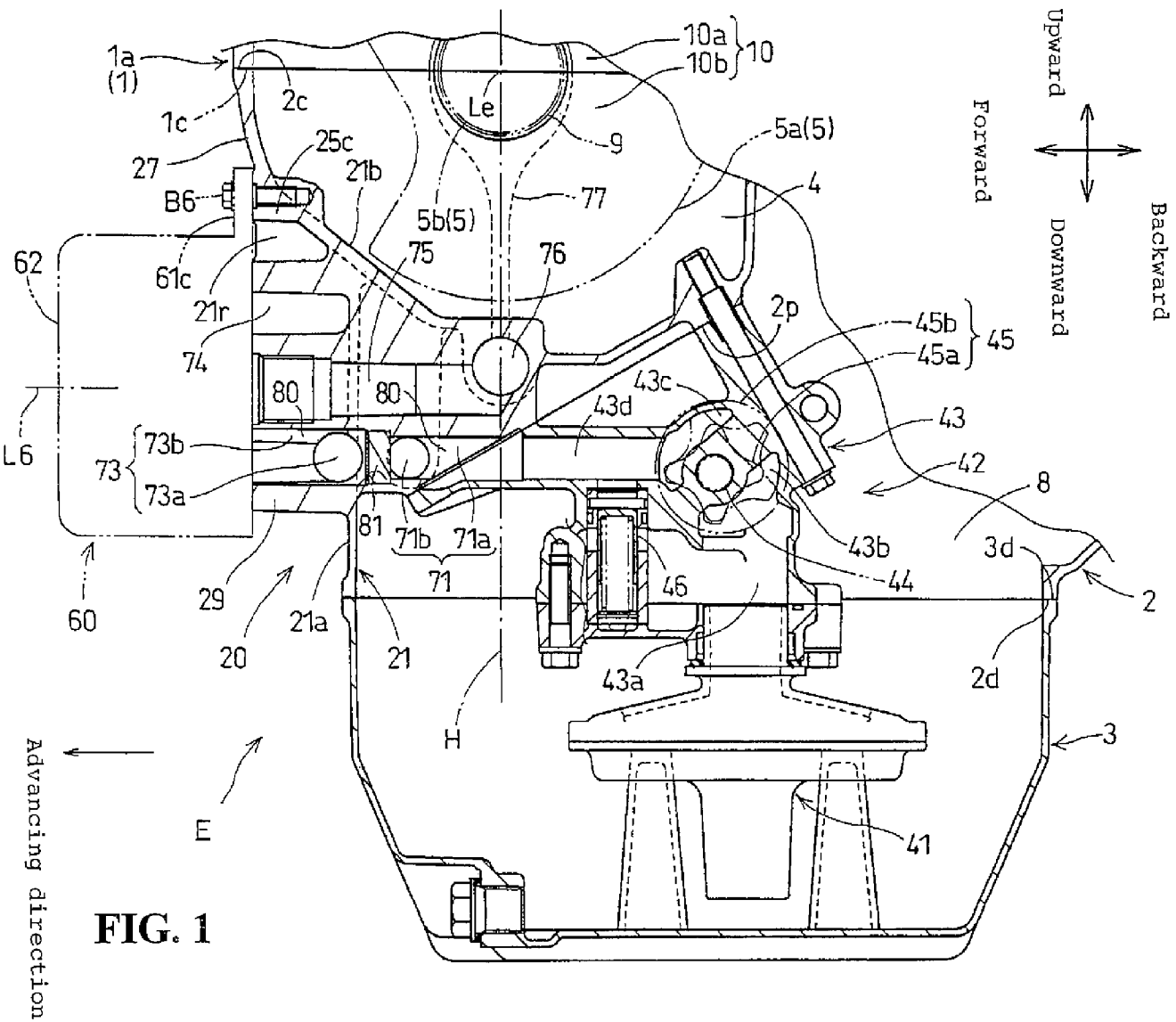
FIG. 1 is a sectional view of essential part of a lower block and an oil pan of an internal combustion engine for a vehicle to which the present invention is applied and is a view corresponding to a section substantially taken along line 1-1 of FIG. 4.
Figure 2:
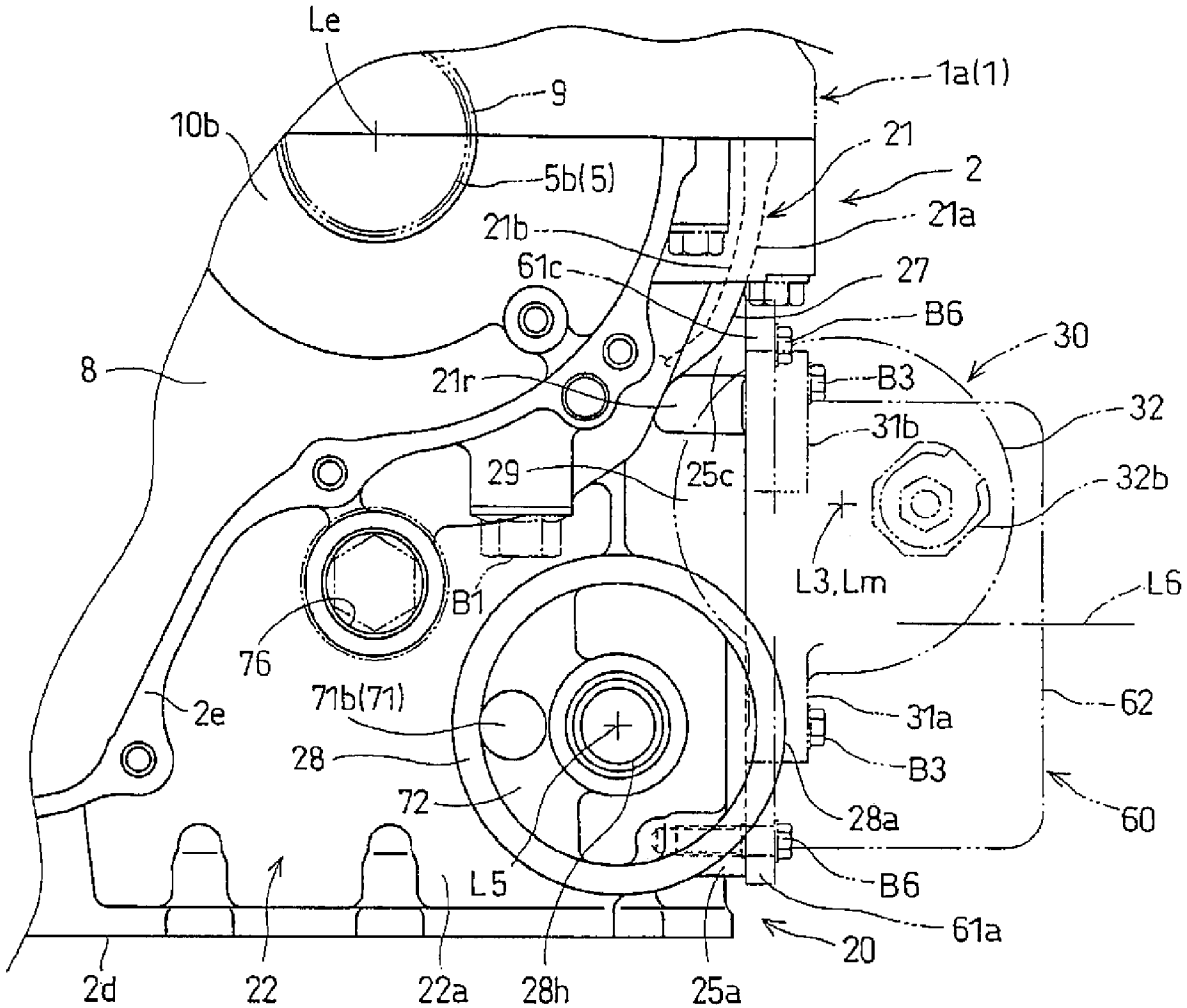
FIG. 2 is a side elevational view of essential part of the lower block of FIG. 1 as viewed in the direction indicated by an arrow mark 2 in FIG. 3.
Figure 3:
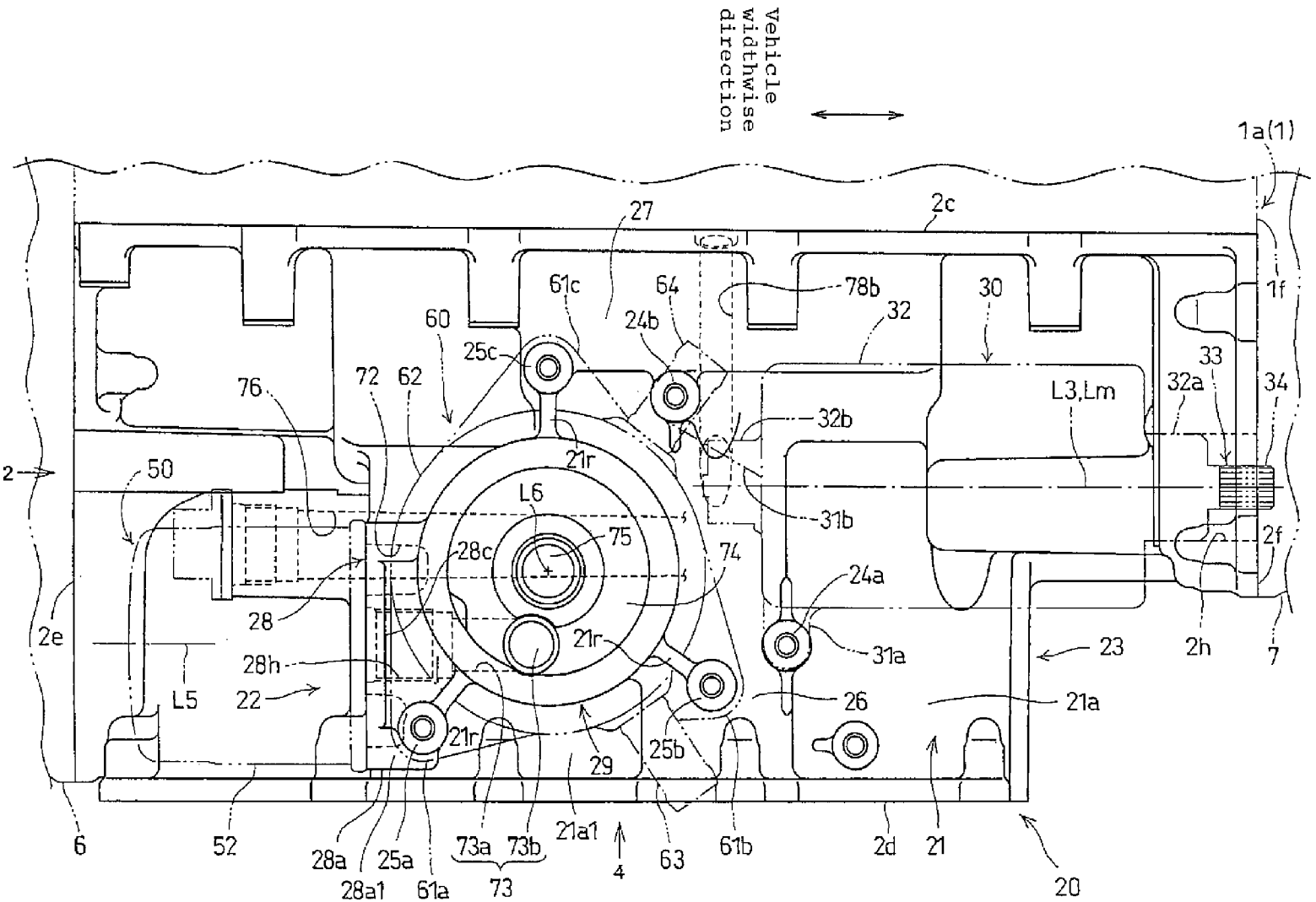
FIG. 3 is a view of the lower block of FIG. 1 as viewed from forwardly.

Referring to FIGS. 1 to 3, an internal combustion engine E for a vehicle to which the present invention is applied is a multi-cylinder four-stroke internal combustion engine and is carried on a motorcycle which is a small-sized vehicle in a transversely mounted arrangement wherein a crankshaft 5 is directed in a vehicle widthwise direction.

The internal combustion engine E includes an apparatus body which in turn includes a cylinder block 1 (refer also to FIG. 5) wherein a plurality of cylinders (not shown) in each of which a piston is fitted for back and forth movement are molded integrally. A lower block 2 is coupled to a lower portion 1*a* of the cylinder block 1 by means of a plurality of bolts with an oil pan 3 coupled to a lower portion of the lower block 2. A cylinder head (not shown) is coupled to an upper portion of the cylinder block 1. The lower portion 1*a* as an upper side crankcase and the lower block 2 as a lower side crankcase form a crankcase which forms a crank chamber 4 in which the crankshaft 5 is accommodated. The lower portion 1*a* and the lower block 2 are coupled air-tight to each other at coupling faces 1*c* and 2*c*. In addition, the lower block 2 and the oil pan 3 are coupled air-tight to each other by coupling faces 2*d* and 3*d*.

Further, within a valve system chamber formed by the cylinder head, a valve system for driving intake valves and exhaust valves to open and close in synchronism with the rotation of the crankshaft 5 is disposed.

To a right end face 1*e* of the lower portion 1*a* and a right end face 2*e* of the lower block 2, a cover 6 (refer to FIG. 3) which covers an opening surrounded by and formed from the end faces 1*e* and 2*e* is coupled. In addition, to a left end face 1*f* of the lower portion 1*a* and a left end face 2*f* of the lower block 2, a cover 7 (refer to FIG. 3) which covers an opening surrounded by and formed from the end faces 1*f* and 2*f* is coupled. An oil atmosphere space 8 (refer, also to FIG. 4) which is an external space with respect to the crank chamber 4 and which is also a space above oil accumulated in the oil pan 3 is formed by the covers 6 and 7, the lower block 2 and the oil pan 3.

It is to be noted that, the forward and backward, upward and downward, and leftward and rightward directions are represented with reference to the vehicle on which the internal combustion engine E is carried, and coincide with the forward and backward, upward and downward, and leftward and rightward directions of the vehicle, respectively. The vehicle widthwise direction is a sideward direction with respect to the forward and backward direction and coincides with the leftward and rightward direction. Further, where one of the leftward and rightward directions is one of the opposite vehicle widthwise directions or one of the opposite sideward directions, the other of the leftward and rightward directions is the other of the opposite vehicle widthwise directions or the other of the opposite sideward directions.

Figure 4:
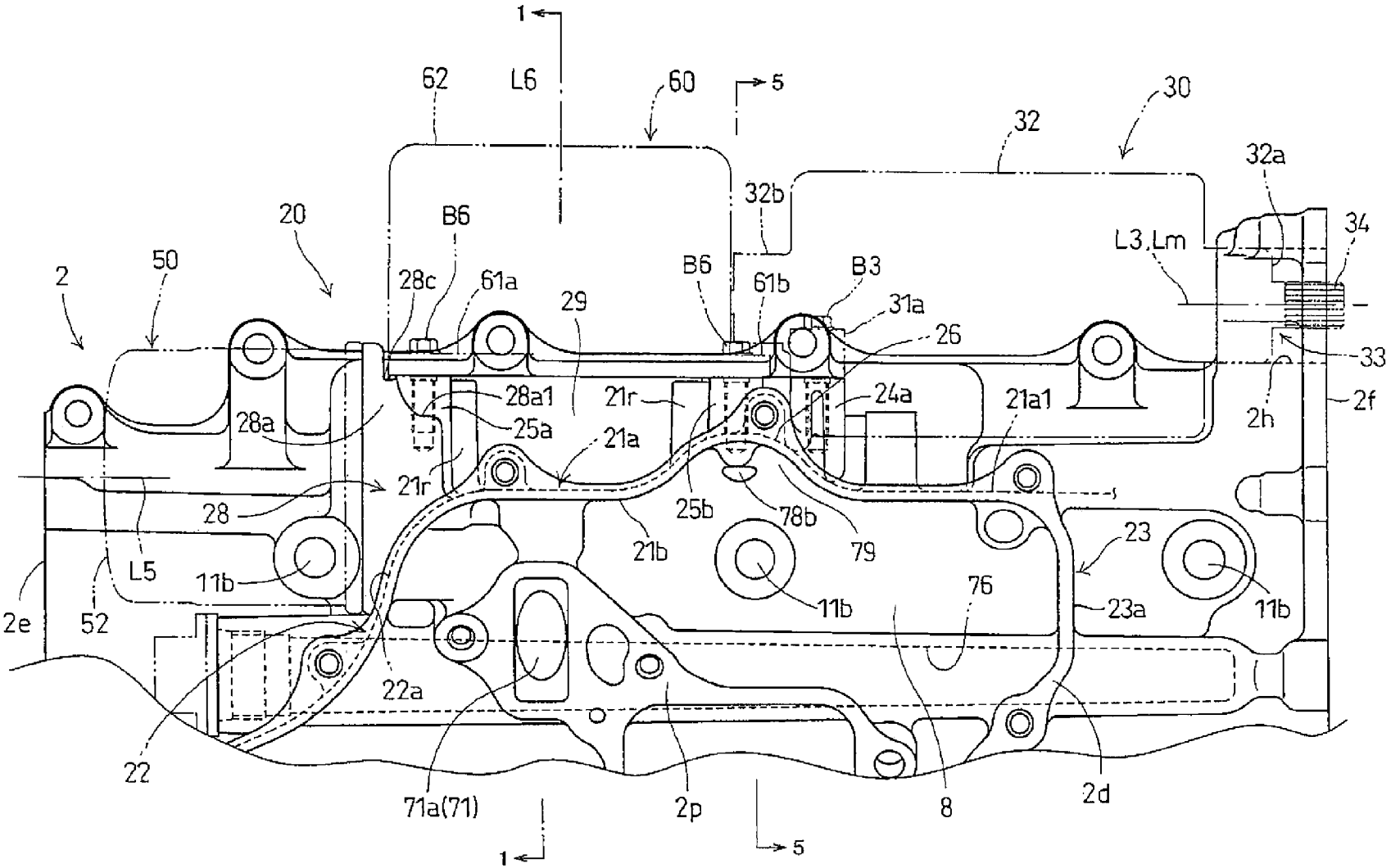
FIG. 4 is a view of the lower block of FIG. 1 as viewed in the direction indicated by an arrow mark 4 of FIG. 3.
Figure 5:
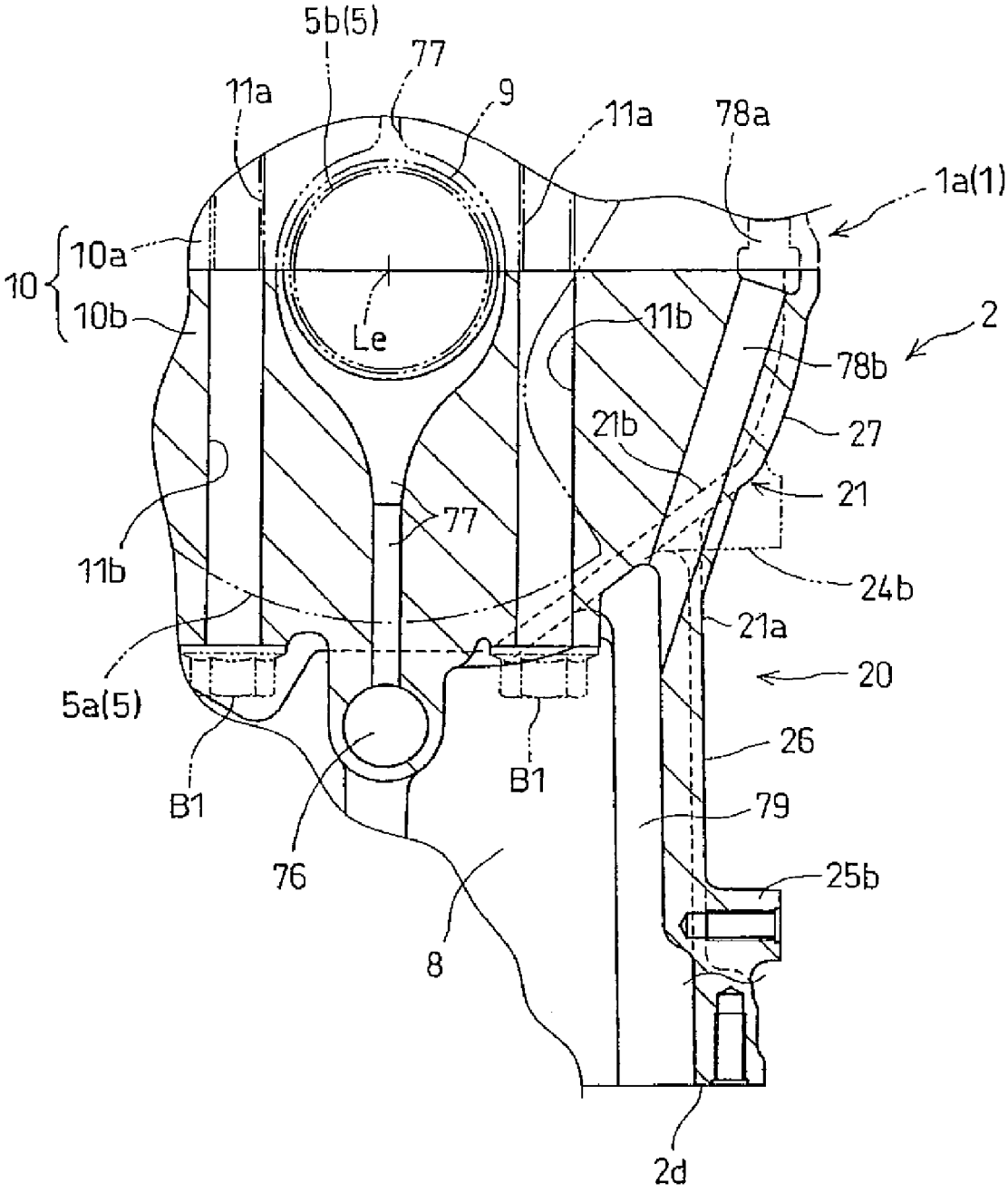
FIG. 5 is a sectional view of an essential part taken substantially along line 5-5 of FIG. 4.

The crankshaft 5 is supported for rotation on the lower portion 1*a* and the lower block 2 through a plurality of main bearings 9 (refer also to FIG. 5). The crankshaft 5 is driven to rotate by the pistons which are driven to move back and forth by the pressure of combustion gas generated by combustion of an air fuel mixture in the combustion chambers formed between the cylinder head and the pistons. Each of the main bearings 9 in the form of a slide bearing is held by a bearing retaining portion 10 formed from an upper bearing retaining portion 10*a* (refer also to FIG. 5) provided at the lower portion 1*a* and a lower bearing retaining portion 10*b* provided on the lower block 2 and supports a journal portion 5*b* of the crankshaft 5 for rotation thereon. In each of the bearing retaining portions 10, the bearing retaining portions 10*a* and 10*b* are coupled to each other by bolts B1 screwed in a pair of screw holes 11*a* (refer to FIG. 5) provided in the upper bearing retaining portion 10*a* through a pair of fitting holes 11*b* (refer to FIGS. 4 and 5) provided in the lower bearing retaining portion 10*b* at positions between which the journal portion 5*b* is positioned in the forward and backward direction. The cylinder block 1 and the lower block 2 are coupled to each other also by the bolts B1.

Referring to FIG. 1 to 4, the internal combustion engine E includes a starter motor 30 which is an electric motor for driving the crankshaft 5 to rotate and which drives the crankshaft 5 to rotate upon starting of the internal combustion engine E, and a lubrication system for introducing oil to oil supply receiving portions such as lubrication portions of the internal combustion engine E. The lubrication system of the dry sump type includes the oil pan 3 serving as an oil accumulation section, an oil strainer 41 disposed in the oil pan 3, an oil pump 42 driven to rotate by power of the crankshaft 5, an oil filter 50 for cleaning lubricating oil discharged from the oil pump 42, an oil cooler 60 for cooling the lubricating oil circulated through the oil filter 50, a large number of oil paths and so forth.

A front portion 20 of the lower block 2 of the engine body which is a portion positioned forwardly of a specific plane H (refer to FIG. 1) which includes the cylinder axial lines of the cylinders and extends in parallel to a rotational center line Le of the crankshaft 5, the oil cooler 60, oil filter 50 and starter motor 30 are attached at positions facing in the advancing direction of the vehicle.

The front portion 20 of the lower block 2 which is a single member formed by casting has a front wall 21 which is a wall directed in the advancing direction of the vehicle, right and left side walls 22 and 23 individually connecting to the front wall 21, a front face 21*a* which is a face directed in the forward direction which is the advancing direction of the front wall 21, a right side face 22*a* directed rightwardly on the right side wall 22, and a left side face 23*a* directed leftwardly on the left side wall 23. The front face 21*a*, right side face 22*a* and left side face 23*a* form an outer face of the front portion 20. Further, the right side face 22*a* and the left side face 23*a* are side faces directed in the sideward directions perpendicular to the forward and backward direction as viewed in the upward and downward directions (hereinafter referred to as "as viewed in plan").

The starter motor 30 and the oil cooler 60 are disposed on the front face 21*a*, and the oil filter 50 is disposed on the right side face 22*a*. Further, as viewed from the advancing direction (that is, from the forward direction) (hereinafter referred to as "as viewed from the forward direction"), the oil cooler 60 and the oil filter 50 are disposed in a neighboring relationship to each other in the vehicle widthwise direction, and the starter motor 30 is disposed remotely from the oil filter 50 with respect to the oil cooler 60 in the vehicle widthwise direction. Therefore, the starter motor 30, oil cooler 60 and oil filter 50 are disposed in a serially juxtaposed relationship to each other in the vehicle widthwise direction.

Referring to FIGS. 2 to 4, the starter motor 30 includes a motor body, and two, as a plural number, motor attaching portions 31*a* and 31*b* for attaching the starter motor 30 to the front wall 21 of the lower block 2. The motor body includes a cylindrical cooler case 32 accommodating an armature therein and having a center axial line L3 parallel to the rotational center line Le of the crankshaft 5 and directed in the vehicle widthwise direction, and a drive shaft 33 having a rotational center line Lm parallel to the center axial line L3 and projecting to the left from the cooler case 32. The cooler case 32 has a cylindrical supported portion 32*a* inserted in a through-hole 2*h* provided at a left end portion of the lower block 2 having the left end face 2*f* and held at the left end portion, and a terminal portion 32*b* for feeding in the form of a projection which projects to the right.

A pinion 34 is provided on the drive shaft 33. While the pinion 34 is molded, in the present embodiment, integrally with the drive shaft 33, it may be a separate member from the drive shaft 33. The drive shaft 33 drives the crankshaft 5 to rotate through a starting speed reduction mechanism formed from a gear train including the pinion 34. Further, as viewed from the forward direction, the drive shaft 33 in the motor body is a portion which defines a maximum width of the starter motor 30 in the vehicle widthwise direction.

Referring also to FIG. 5, the starter motor 30 is fastened and secured to two motor attachment bosses 24*a* and 24*b* which are part of the front wall 21 and serving as motor attachment seats projecting forwardly from the front face 21*a* at the two motor attaching portions 31*a* and 31*b* each in the form of a bracket by means of bolts B3. The attachment boss 24*a* which is disposed rather downwardly from among all motor attaching portions 31*a* and 31*b* and downwardly with respect to the center axial line L3 or the rotational center line Lm is provided at a projecting face 26. The front face 21*a* is formed in such a manner so as to project forwardly from the projecting face 26. The projecting face 26 is a face formed by causing part of an inner face 21*b* of the front wall 21 to be curved so as to have a concave face as viewed in plan such that part of the front face 21*a* is curved in the form of a convex face as viewed in a plan view and projects forwardly in order to form a returning oil path 79 which is an eaves-like oil path for returning oil having lubricated the valve system (which is part of the oil supply receiving section) which is a lubricating place provided on the cylinder head.

Since the attachment boss 24*a* projects forwardly from the projecting face 26 in this manner, the projection amount of the attachment boss 24*a* can be reduced when compared with that in an alternative case wherein it is provided on a face 21*a*1 (refer to FIGS. 3 and 4) which does not project forwardly different from the projecting face 26. In addition, since the starter motor 30 is attached to the front wall 21 such that an air gap is formed between the cooler case 32 and the front face 21*a*, heat transmission from the front wall 21 is suppressed. In addition, the heat radiation area to the air increases, resulting in an improvement of the cooling property of the starter motor 30.

The other attachment boss 24*b* that is different from the attachment boss 24*a* and disposed higher than the attachment boss 24*a* and the center axial line L3 or the rotational center line Lm is provided on a swollen face 27 (refer also to FIG. 1) which the front face 21*a* has in such a manner so as to project forwardly from the swollen face 27. The swollen face 27 is a face which is formed by causing the inner face 21*b* of the front wall 21 to be curved into a concave face as viewed in a direction parallel to the rotational center line Le of the crankshaft 5 (in the present embodiment, also as viewed from the vehicle widthwise direction (hereinafter referred to "as viewed from the sideward direction") such that part of the front face 21*a* is curved into a convex face as viewed from the sideward direction in order to prevent an interference with a crank web 5*a* of the crankshaft 5.

Where the attachment boss 24*b* projects forwardly from the swollen face 27 in this manner, the projection amount of the attachment boss 24*b* can be reduced when compared with that in an alternative case wherein the attachment boss 24*b* is provided on the front face 21*a*.

Referring to FIGS. 1 to 4, the oil cooler 60 of the water cooled type includes a cooler body, and three, as a plural number, cooler attaching portions 61*a*, 61*b* and 61*c* for attaching the oil cooler 60 to the front wall 21. The cooler body includes a cylindrical cooler case 62 accommodating a heat exchange section and having a center axial line L6 directed forwardly, and a pair of pipe couplings 63 and 64 (refer to FIG. 3) provided on the case 62 and projecting outwardly in a radial direction from the case 62. The pipe coupling 63 is a cooling water entrance section into which part of cooling water discharged from a cooling water pump which composes a cooling system for the internal combustion engine E flows. The pipe coupling 64 is a cooling water exit section from which cooling water after heat exchange with oil by the heat exchange section flows. Meanwhile, the case 62 is a portion of the oil cooler 60 which defines a maximum width in the vehicle widthwise direction.

Referring also to FIG. 5, the oil cooler 60 is secured in a state wherein it is seated oil-tight on a cylindrical cooler attachment seat 29 which is part of the front wall 21 and projects forwardly from the front face 21*a*. The three cooler attaching portions 61*a*, 61*b* and 61*c*, which generally form a flange-like attaching portion, are fastened and secured to cooler attachment bosses 25*a*, 25*b* and 25*c* which are part of the front wall 21 and project forwardly from the front face 21*a* and are connected to the attachment seat 29 by a rib 21*r* by means of bolts B6.

The two attachment bosses 25*a* and 25*b*, which are disposed comparatively downwardly and below the center axial line L6 from among all attachment bosses 25*a*, 25*b* and 25*c*, are provided in such a manner so as to project forwardly from a swollen portion 28*a* hereinafter described of an attachment seat 28, to which the oil filter 50 is attached, and the projecting face 26, respectively. Further, the attachment boss 25*c* different from the attachment bosses 25*a* and 25*b* and are disposed higher than the attachment bosses 25*a* and 25*b*, center axial line L6 and center axial line L3 is provided on the swollen face 27 in such a manner so as to project forwardly from the swollen face 27.

In this manner, the attachment boss 25*a* projects forwardly from the swollen portion 28*a*, the attachment boss 25*b* that is different from the attachment boss 25*a* projects forwardly from the projecting face 26 and the attachment boss 25*c* projects forwardly from the swollen face 27. Thus, the projection amount of each of the attachment bosses 25*a*, 25*b* and 25*c* can be reduced.

As shown in FIG. 3, the attachment boss 24*b* disposed at a position different from that of the pipe coupling 64 as viewed from a forward direction is disposed rather near to the center axial line L6 than the attachment boss 25*b* in the vehicle widthwise direction and that the attachment boss 24*b* is disposed at a position overlapping with the case 62 at the position in the vehicle widthwise direction. Thus, the oil cooler 60 and the starter motor 30 can be positioned closely to each other in the vehicle widthwise direction. Therefore, the oil cooler 60 and the starter motor 30 can be disposed compactly in the vehicle widthwise direction.

Referring to FIGS. 2 to 4, the oil filter 50 includes a cylindrical case 52 which accommodates a filtering member and has a center axial line L5 directed in the vehicle widthwise direction. The filter attachment seat 28, wherein the oil filter 50 is attached in a state wherein the case 52, is seated oil-tight in a cylindrical projection which is provided on the right side face 22*a* and projects to the right. Further, the oil filter 50 is secured to the attachment seat 28 such that a threaded portion of an attachment conduit (not shown) which forms an oil path along which oil having passed through and is cleaned by the filtering member is threaded into a threaded portion 28*h* provided on the inner side of the attachment seat 28.

Part of the attachment seat 28 is molded integrally with the attachment seat 29 and projects to the right from the attachment seat 29 (refer to FIGS. 3 and 4). Further, a front portion as a portion of the attachment seat 28 forms the swollen portion 28*a* which is swollen in the forward direction in an arc as viewed from the sideward direction from the right side face 22*a*. The swollen portion 28*a* has the attachment boss 25*a* projecting forwardly from a swollen face 28*a*1 which is a front face of the swollen portion 28*a*, and a cutaway portion 28*c* for preventing an interference between the swollen portion 28*a* and an attaching portion 61*a*.

As shown in FIG. 3, the attaching portion 61*a*, attachment boss 25*a* and attachment seat 28 are disposed so as to overlap with each other as viewed from the forward direction. Thus, the case 62 and the attachment seat 28 overlap with each other as viewed from the forward direction and that the attaching faces 28 and 29 are molded integrally. In addition, the oil cooler 60 and the oil filter 50 can be positioned closely to each other in the vehicle widthwise direction. Consequently, the oil cooler 60 and the oil filter 50 can be disposed in a compact manner in the vehicle widthwise direction. Thus, a reduction in the length of a communication oil path 73 hereinafter described can be anticipated.

Further, the oil filter 50 does not project to the right from the right end face 2*e* of the lower block 2 on the right side (refer to FIGS. 3 and 4). Thus, the oil filter 50 can be disposed entirely within the width of the lower block 2 in the vehicle widthwise direction. Therefore, the internal combustion engine E to which the oil filter 50 is attached becomes compact in the vehicle widthwise direction.

Referring to FIG. 3, the oil cooler 60 is disposed with respect to the oil filter 50 such that the center axial line L6 is positioned above the center axial line L5, and the starter motor 30 is disposed with respect to the case 62 of the oil cooler 60 such that the rotational center line Lm and the center axial line L3 of the drive shaft 33 are positioned higher than the center axial line L6.

In the following, the lubrication system mentioned hereinabove is described.

Referring to FIGS. 1 and 5, oil accumulated in the oil pan 3 is sucked into the oil pump 42 through the oil strainer 41. After the oil discharged from the oil pump 42 circulates through the oil filter 50 and the oil cooler 60, it flows into a main oil path 76 (refer also to FIGS. 2 to 4) which is provided in the lower block 2 and extends linearly along the rotational center line Le just below the rotational center line Le of the crankshaft 5. The oil in the main oil path 76 circulates along a plurality of branch oil paths branching from the main oil path 76 and is supplied to the oil supply receiving portions including the lubrication portion of the internal combustion engine E. Each oil path 77 which corresponds to one of the bearing retaining portions 10 is open to the main bearing 9 (which is part of the oil supplying section) and extends to the cylinder head through the cylinder block 1, and supplies the oil of the main oil path 76 to the valve system (which is part of the oil supplying section) provided in the cylinder head.

The oil supplied to the oil supply receiving portions in the crank chamber 4 through the branch oil paths drops or flows down from the oil supply receiving portions in the crank chamber 4 and gathers together at the bottom in the crank chamber 4, whereafter it is collected by a scavenging pump. The oil collected by the scavenging pump is used for lubrication of a transmission accommodated in a mission case molded integrally with the cylinder block 1 and the lower block 2, and then returns to the oil pan 3 through the oil atmosphere space 8.

Further, the oil from the cylinder head after it lubricates the valve system circulates through returning oil paths 78*a* and 78*b* (refer to FIG. 4) formed from holes provided in the cylinder block 1 and the lower block 2, respectively. Thereafter, the oil returns to the oil pan 3 through the returning oil path 79 and the oil atmosphere space 8.

Referring to FIG. 1, the oil pump 42 in the form of a trochoid pump disposed in the oil atmosphere space 8 includes a pump housing 43 attached to the lower block 2, a pump shaft 44 driven to rotate by the crankshaft 5 through a transmission mechanism of the chain type, and a pump rotor 45 formed from an inner rotor 45*a* and an outer rotor 45*b* accommodated in the pump housing 43 and forming a pump chamber.

The pump housing 43 includes an intake oil path 43*a* and an intake port 43*b* for introducing the oil sucked in from the oil pan 3 through the oil strainer 41 connected to the pump housing 43 into the pump chamber, a discharge port 43*c* to which the oil from the pump chamber is discharged and a discharge oil path 43*d* connecting to the discharge port 43*c*, and a relief valve 46 for releasing excessive pressure in the discharge oil path 43*d*.

Referring also FIGS. 2 to 5, the discharge oil path 43*d* extending linearly forwardly from the discharge port 43*c* is in communication with an introduction oil path 71, which is provided in the lower block 2 for introducing oil from the oil pump 42 into the oil filter 50, at a pump attaching face 2*p* of the lower block 2. Accordingly, the oil discharged from the oil pump 42 circulates from the discharge oil path 43*d* through the introduction oil path 71 and flows into an annular oil path 72 provided on the attachment seat 28 of the oil filter 50, whereafter it passes through the filtering member of the oil filter 50. Further, the oil passes through the attachment conduit and circulates along the communication oil path 73, which introduces oil from the oil filter 50 to the oil cooler 60, and then flows into an annular oil path 74 provided in the attachment seat 29 of the oil cooler 60 and then flows into the heat exchange section. The oil from the oil cooler 60 after it exchanges heat with cooling water in the heat exchange section flows into the main oil path 76 through a discharge oil path 75 disposed on the inner side of the attachment seat 29.

The introduction oil path 71 is a path bent in an L shape which is formed from a first oil path 71*a* on the upstream side and a second oil path 72*b* on the downstream side. The communication oil path 73 which communicates the oil filter 50 and the oil cooler 60 with each other in the front portion 20 is a path bent in an L shape and formed from a first oil path 73*a* on the upstream side and a second oil path 73*b* on the downstream side. The first oil path 71*a* and the second oil path 73*b* are a hole 80 (refer to FIG. 1) formed to extend along a half line extending from the oil pump 42 to the oil cooler 60 by drilling from the front face 21*a* and are formed from through-holes which are open to the front face 21*a* and the pump attaching face 2*p*. The hole 80 is intermediately partitioned into two portions by a plug 81 as a partition member to form the first oil path 71*a* and the second oil path 73*b*.

The introduction oil path 71, communication oil path 73, discharge oil path 75 and main oil path 76 are provided in the inside of the front portion 20 of the lower block 2. The discharge oil path 43*d*, first oil path 71*a*, second oil path 73*b* and discharge oil path 75 extend linearly in the forward and rearward directions. The discharge oil path 43*d*, first oil path 71*a*, and the second oil path 73*b* are paths juxtaposed on a straight line from the discharge port 43*c*. In addition, the second oil path 71*b*, first oil path 73*a* and main oil path 76 extend linearly in the vehicle widthwise direction substantially in parallel to the rotational center line Le.

Further, the main oil path 76, discharge oil path 75, introduction oil path 71 and communication oil path 73 are disposed in an order from the side near to the crankshaft 5 or the rotational center line Le in the upward and downward direction as a specific direction along which the distance between the rotational center line Le of the crankshaft 5 and the main oil path 76 is shortest. Accordingly, the main oil path 76 and the discharge oil path 75 are disposed nearer to the crankshaft 5 or the rotational center line Le than the introduction oil path 71 and the communication oil path 73.

Next, the action and effects of the embodiment configured in such a manner as described above are described.

The oil cooler 60, oil filter 50 and starter motor 30 are disposed on the outer face formed from the front face 21*a* of the front portion 20 of the lower block 2 as the engine body is directed in the advancing direction. The side faces 22*a* and 23*a* of the front portion 20 of the lower block 2 are disposed as the engine body is directed sidewardly perpendicularly to the advancing direction. The communication oil path 73 is provided in the inside of the front portion 20 while the starter motor 30 is disposed so as to face in the advancing direction. The starter motor 30 is attached at the position of the front portion 20 of the lower block 2 which faces in the advancing direction of the vehicle and is cooled by an air flow. Therefore, the cooling performance of the starter motor 30 is improved. In addition, since the starter motor 30 is disposed on the front face 21*a* which forms the outer face, the starter motor 30 can be disposed at a position at which air flow is likely to be received. In addition, since the starter motor 30 does not restrict the formation of the communication oil path 73 which is provided in the inside of the front portion 20, although the starter motor 30 is disposed in the front portion 20, the degree of freedom in the arrangement of the oil cooler 60 and the oil filter 50 is not restricted.

The oil cooler 60 is disposed on the front face 21*a* of the front portion 20 directed in the forward direction and the oil filter 50 is attached to the attachment seat 28 provided on the right side face 22*a* of the front portion 20 which is directed in the sideward direction while part of the attachment seat 28 forms the swollen portion 28*a* which is swollen forwardly from the right side face 22*a* and the attachment boss 25*a* to which the oil cooler 60 is attached is provided on the swollen portion 28*a* in such a manner so as to project in the forward direction. The projection amount of the attachment boss 25*a* can be reduced by an amount by which the swollen portion 28*a* projects in the forward direction. Consequently, the rigidity of the attachment boss 25*a* is raised and the attachment boss 25*a* is reduced in size and weight. Further, since the attachment boss 25*a* is provided on the attachment seat 28 and hence the oil cooler 60 and the oil filter 50 can be disposed closely to each other, the communication oil path 73 can be reduced in length and the pressure loss (and accordingly the communication resistance) of oil can be reduced. In addition, this contributes to a compaction of the arrangement of the oil cooler 60 and the oil filter 50. Further, since the contact area between the attachment seat 28 and air flow increases by an amount corresponding to the swollen portion 28*a* which is swollen in the forward direction, the swollen portion 28*a* serves as a heat radiation section and contributes to an improvement of the cooling performance of oil which circulates through the oil filter 50.

The front face 21*a* has the projecting face 26 which projects forwardly and the attachment boss 25*b* to which the oil cooler 60 is attached and the attachment boss 24*a* to which the starter motor 30 is attached are provided on the projecting face 26 such that they project in the forward direction from the projecting face 26. The projection amount of the attachment bosses 24*a* and 25*b* can be reduced by an amount by which the projecting face 26 projects in the forward direction. Therefore, the rigidity of the attachment bosses 24*a* and 25*b* is raised, and the attachment bosses 24*a* and 25*b* are reduced in size and weight.

The oil cooler 60 has the cylindrical case 62 which in turn the center axial line L6 is directed in the forward direction and the starter motor 30 has the drive shaft 33 which projects in the vehicle widthwise direction from the front portion 20 that are disposed in a juxtaposed relationship with each other in the vehicle widthwise direction. The starter motor 30 is disposed such that the rotational center line Lm of the drive shaft 33 is positioned higher than the center axial line L6. The drive shaft 33 which is a portion which defines a maximum width of the oil cooler 60 in the vehicle widthwise direction and the case 62 which is a portion which defines a maximum width of the starter motor 30 in the vehicle widthwise direction can be disposed in an offset relationship in the upward and downward direction. As a result, the oil cooler 60 and the starter motor 30 can be disposed further closely to each other in the vehicle widthwise direction. Thus, a compact arrangement of the oil cooler 60 and the starter motor 30 in the vehicle widthwise direction can be anticipated. Also where the starter motor 30, which has a large size in the vehicle widthwise direction is adopted, the projection of the drive shaft 33 in the vehicle widthwise direction can be suppressed. Consequently, an increase in the size of the internal combustion engine E in the vehicle widthwise direction can be suppressed.

Since, from among the starter motor 30, oil cooler 60 and oil filter 50, the starter motor 30 having the drive shaft 33 which projects to the left from the left end face 2*f* of the lower block 2 is disposed most upwardly. The oil filter 50 that is disposed most downwardly does not project rightwardly from the right end face 2*e* of the lower block 2 on the right side. Thus, the bank angle of the motorcycle can be set to a great angle.

Since the front face 21*a* has the swollen face 27 that is formed such that the front wall 21 having the front face 21*a* is curved and projects in the forward direction in order to prevent an interference with the crank web 5*a* of the crankshaft 5. The attachment boss 25*c* to which the oil cooler 60 is attached and the attachment boss 24*b* to which the starter motor 30 is attached are provided on the swollen face 27 in such a manner as to project forwardly, the projection amount of the attachment bosses 24*b* and 25*c* projecting forwardly from the swollen face 27 which prevents an interference with the crank web 5*a* can be reduced by an amount by which the swollen face 27 projects forwardly. Therefore, the rigidity of the attachment bosses 24*b* and 25*c* can be raised and the attachment bosses 24*b* and 25*c* can be reduced in size and weight.

Since the lower block 2 forms the crankcase and the oil filter 50 is entirely disposed within the width of the crank web 5*a* of the crankshaft 5, the oil filter 50 can be disposed rather near to the center of the lower block 2 in the vehicle widthwise direction. Consequently, the projection of the oil filter 50 in the vehicle widthwise direction is prevented and the appearance of the internal combustion engine E is improved.

The hole 80 extending linearly along a half line extending from the oil pump 42 to the oil cooler 60 is partitioned by the plug 81 to form the first oil path 71*a* and the second oil path 73*h*. The first oil path 71*a* is the introduction oil path 71 which introduces oil from the oil pump 42 to the oil filter 50 while the second oil path 73*b* is the communication oil path 73 for introducing the oil from the oil filter 50 to the oil cooler 60. Further, the oil from the oil cooler 60 flows into the main oil path 76 from which the oil path 77 for supplying oil to the main bearings 9 of the crankshaft 5 through the discharge oil path 75. The discharge oil path 75 and the main oil path 76 are disposed rather near to the crankshaft 5 in the upward and downward direction than the introduction oil path 71 and the communication oil path 73. The first oil path 71*a* and the second oil path 73*b* which are part of an oil path for introducing the oil from the oil pump 42 to the oil cooler 60 are formed by partitioning the hole 80 which extends linearly from the oil pump 42 to the oil cooler 60. Therefore, the formation of the introduction oil path 71 and the communication oil path 73 is facilitated. Further, since the discharge oil path 75 and the main oil path 76 are disposed rather near to the crankshaft 5 than the introduction oil path 71 and the communication oil path 73, the oil path length from the main oil path 76 to the main bearing 9 can be reduced. Consequently, the pressure loss of oil to be supplied to the main bearing 9 can be reduced.

In the following, embodiments wherein the configuration of part of the embodiment described above is modified are described in regard to the modified configurations.

The oil filter 50 may be attached to the left wall of the front portion 20. In this instance, the starter motor 30 is disposed on the right side remote from the oil filter 50 with respect to the oil cooler 60 in the vehicle widthwise direction.

The electric motor may serve also as the starter motor 30 and may assist the rotation of the crankshaft 5 upon starting or acceleration of the vehicle.

The internal combustion engine may be incorporated in a vertically mounted arrangement wherein the crankshaft is directed in the forward and backward direction in the vehicle. In this instance, the specific plane described above is a plane which includes the cylinder axial line of the frontmost cylinder and extends perpendicularly to the rotational center line of the crankshaft. The starter motor may be disposed on a side face of the front portion.

The internal combustion engine may be a single-cylinder internal combustion engine.

The small-sized vehicle may be a four-wheeled vehicle of the saddle type.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An internal combustion engine for a vehicle which includes an oil cooler, an oil filter communicating with said oil cooler through a communication oil path, and an electric motor configured to drive a crankshaft to rotate and wherein said oil cooler and said oil filter are attached to a front portion of an engine body for facing in an advancing direction of said vehicle, comprising:

said oil cooler, said oil filter and said electric motor are disposed on an outer face of said front portion which includes a front face which faces in a forward direction which is the advancing direction and a side face directed in sideward direction perpendicular to the advancing direction, and said communication oil path is provided in the inside of said front portion while said electric motor is disposed so as to face forwardly, wherein said oil cooler has a cylindrical case having a center axis directed forwardly and said electric motor has a drive shaft projecting in a vehicle widthwise direction from said front portion disposed in a juxtaposed relationship in the vehicle widthwise direction, and said electric motor is disposed wherein the center line of rotation of said drive shaft is positioned higher than the center axis thereof.

2. The internal combustion engine for the vehicle according to claim 1, wherein said oil cooler is disposed on said front face, said oil filter is attached to an attachment seat provided on said side face, part of said attachment seat has a swollen portion formed therein that is swollen forwardly from said side face, and a first oil cooler attachment boss to which said oil cooler is attached is provided at said swollen portion to project forwardly.

3. The internal combustion engine for the vehicle according to claim 2, wherein said oil cooler has a cylindrical case having a center axis directed forwardly and said electric motor has a drive shaft projecting in a vehicle widthwise direction from said front portion disposed in a juxtaposed relationship in the vehicle widthwise direction, and said electric motor is disposed such that the center line of rotation of said drive shaft is positioned higher than the center axis thereof.

4. The internal combustion engine for the vehicle according to claim 3, wherein said engine body has said front portion being a crankcase, and said oil filter is entirely disposed within the width of said crankcase in the vehicle widthwise direction.

5. The internal combustion engine for the vehicle according to claim 2, wherein said front face has a swollen face formed by causing a front wall having said front face to be curved and project in a forward direction for preventing interference with a crank web of said crankshaft, and a second oil cooler attachment boss to which said oil cooler is attached, and a second motor attachment boss to which said electric motor is attached are provided to project in the forward direction on said swollen face.

6. The internal combustion engine for the vehicle according to claim 2, wherein said engine body has said front portion being a crankcase, and said oil filter is entirely disposed within the width of said crankcase in the vehicle widthwise direction.

7. The internal combustion engine for the vehicle according to claim 2, wherein a hole which extends linearly along a half line which extends from said oil pump to said oil cooler is partitioned by a partition member to form a first oil path and a second oil path, said first oil path is an introduction oil path for introducing oil from said oil pump to said oil filter, said second oil path is said communication oil path for introducing the oil from said oil filter to said oil cooler, the oil from said oil cooler flows into a main oil path from which an oil path for supplying the oil to a main bearing for said crankshaft through a discharge oil path, and said discharge oil path and said main oil path are disposed nearer to said crankshaft than said introduction oil path and said communication oil path.

8. The internal combustion engine for the vehicle according to claim 1, wherein said front face has a projecting face which projects forwardly, and a first oil cooler attachment boss to which said oil cooler is attached and a first motor attachment boss to which said electric motor is attached are provided on said projecting face to project forwardly from said projecting face.

9. The internal combustion engine for the vehicle according to claim 8, wherein said oil cooler has a cylindrical case having a center axis directed forwardly and said electric motor has a drive shaft projecting in a vehicle widthwise direction from said front portion disposed in a juxtaposed relationship in the vehicle widthwise direction, and said electric motor is disposed such that the center line of rotation of said drive shaft is positioned higher than the center axis thereof.

10. The internal combustion engine for the vehicle according to claim 8, wherein said front face has a swollen face formed by causing a front wall having said front face to be curved and project in a forward direction for preventing interference with a crank web of said crankshaft, and a second oil cooler attachment boss to which said oil cooler is attached, and a second motor attachment boss to which said electric motor is attached are provided to project in the forward direction on said swollen face.

11. The internal combustion engine for the vehicle according to claim 8, wherein said engine body has said front portion being a crankcase, and said oil filter is entirely disposed within the width of said crankcase in the vehicle widthwise direction.

12. The internal combustion engine for the vehicle according to claim 8, wherein a hole which extends linearly along a half line which extends from said oil pump to said oil cooler is partitioned by a partition member to form a first oil path and a second oil path, said first oil path is an introduction oil path for introducing oil from said oil pump to said oil filter, said second oil path is said communication oil path for introducing the oil from said oil filter to said oil cooler, the oil from said oil cooler flows into a main oil path from which an oil path for supplying the oil to a main bearing for said crankshaft through a discharge oil path, and said discharge oil path and said main oil path are disposed nearer to said crankshaft than said introduction oil path and said communication oil path.

13. The internal combustion engine for the vehicle according to claim 1, wherein said front face has a swollen face formed by causing a front wall having said front face to be curved and project in a forward direction for preventing interference with a crank web of said crankshaft, and a first oil cooler attachment boss to which said oil cooler is attached, and a first motor attachment boss to which said electric motor is attached are provided to project in the forward direction on said swollen face.

14. The internal combustion engine for the vehicle according to claim 1, wherein said engine body has said front portion being a crankcase, and said oil filter is entirely disposed within the width of said crankcase in the vehicle widthwise direction.

15. The internal combustion engine for the vehicle according to claim 1, wherein a hole which extends linearly along a half line which extends from said oil pump to said oil cooler is partitioned by a partition member to form a first oil path and a second oil path, said first oil path is an introduction oil path for introducing oil from said oil pump to said oil filter, said second oil path is said communication oil path for introducing the oil from said oil filter to said oil cooler, the oil from said oil cooler flows into a main oil path from which an oil path for supplying the oil to a main bearing for said crankshaft through a discharge oil path, and said discharge oil path and said main oil path are disposed nearer to said crankshaft than said introduction oil path and said communication oil path.

16. An internal combustion engine for a vehicle comprising:

an oil cooler;

an oil filter;

a communication path for providing communication between said oil filter and said oil cooler; and an electric motor configured to drive a crankshaft to rotate;

wherein said oil cooler and said oil filter are attached to a front portion of an engine body for facing in an advancing direction of said vehicle;

said oil cooler, said oil filter and said electric motor being disposed on an outer face of said front portion which includes a front face which faces in a forward direction which is the advancing direction and a side face directed in a sideward direction perpendicular to the advancing direction;

said communication oil path being provided inside of said front portion while said electric motor is disposed so as to face in a forward direction, wherein a hole which extends linearly along a half line which extends from said oil pump to said oil cooler is partitioned by a partition member to form a first oil path and a second oil path, said first oil path is an introduction oil path for introducing oil from said oil pump to said oil filter, said second oil path is said communication oil path for introducing the oil from said oil filter to said oil cooler, the oil from said oil cooler flows into a main oil path from which an oil path for supplying the oil to a main bearing for said crankshaft through a discharge oil path, and said discharge oil path and said main oil path are disposed nearer to said crankshaft than said introduction oil path and said communication oil path.

* * * * *